US006755644B2

(12) United States Patent
Carbone et al.

(10) Patent No.: US 6,755,644 B2
(45) Date of Patent: Jun. 29, 2004

(54) METHOD AND APPARATUS FOR OPERATING GASEOUS FUEL FIRED HEATER

(75) Inventors: Philip Carbone, North Reading, MA (US); Karen Benedek, Winchester, MA (US); Judith Reich, North Andover, MA (US); Dewi Bramono, Malden, MA (US); Herwig Scheidler, Mainz (DE)

(73) Assignee: Schott Glas, Mainz (DE)

( * ) Notice: Subject to any disclaimer, the term of this patent is extended or adjusted under 35 U.S.C. 154(b) by 127 days.

(21) Appl. No.: 10/025,172

(22) Filed: Dec. 19, 2001

(65) Prior Publication Data

US 2003/0111023 A1 Jun. 19, 2003

(51) Int. Cl.[7] ..... F23D 14/46
(52) U.S. Cl. ..... 431/350; 431/346; 122/504
(58) Field of Search ..... 122/13.01, 17.1, 122/17.2, 18.3, 18.31, 504; 431/346, 350

(56) References Cited

U.S. PATENT DOCUMENTS

| | | | |
|---|---|---|---|
| 4,608,012 | A | 8/1986 | Cooper |
| 4,869,664 | A | 9/1989 | Wright et al. |
| 5,222,476 | A | 6/1993 | Chmielewski |
| 5,317,992 | A | 6/1994 | Joyce |
| 5,355,841 | A | 10/1994 | Moore, Jr. et al. |
| 5,435,716 | A | 7/1995 | Joyce |
| 5,439,372 | A | 8/1995 | Duret et al. |
| 5,494,003 | A | 2/1996 | Bartz et al. |
| 5,511,516 | A | 4/1996 | Moore, Jr. et al. |
| 5,520,536 | A | 5/1996 | Rodgers et al. |
| 5,571,009 | A | 11/1996 | Stålhane et al. |
| 5,632,236 | A | 5/1997 | Joyce |
| 5,641,282 | A | 6/1997 | Lee et al. |
| 5,658,139 | A | 8/1997 | Flanagan et al. |
| 5,791,298 | A | 8/1998 | Rodgers |
| 5,797,355 | A | 8/1998 | Bourke et al. |
| 5,875,739 | A | 3/1999 | Joyce |
| 5,915,954 | A | 6/1999 | Rodgers |
| 6,019,069 | A | 2/2000 | Joyce |
| 6,036,476 | A | 3/2000 | Mitani et al. |
| 6,065,962 | A | 5/2000 | Shizukuisha et al. |
| 6,095,798 | A | 8/2000 | Mitani et al. |
| 6,102,691 | A | 8/2000 | Mitani et al. |
| 6,435,140 | B1 * | 8/2002 | Joyce ..... 122/13.01 |

* cited by examiner

*Primary Examiner*—Jiping Lu
(74) *Attorney, Agent, or Firm*—Pauley Petersen & Erickson

(57) ABSTRACT

A method and apparatus for combusting a fuel and air mixture within a combustion chamber, particularly a combustion chamber of a gaseous fuel fired water heater. A pressure relief void is intentionally formed so that a combustion chamber forms communication with a surrounding environment through means other than the exhaust flue and/or a fuel and/or air inlet. During ignition, the pressure relief void allows pre-combustion fluid within the combustion chamber to escape through both the pressure relief void and the exhaust flue. The pressure relief void reduces or eliminates undesirable noise associated with start-up and operation of conventional water heater combustion chambers with premixed burner systems. The pressure relief void of this invention is preferably sized large enough to relieve an ignition pressure pulse from the combustion chamber upon ignition and yet is sized small enough to prevent a combustion flame from passing through the pressure relief void during ignition and/or operational combustion. The water heater may include two burner assemblies, each which can be easily attached or detached, for quick installation and easy maintenance.

9 Claims, 12 Drawing Sheets

METHOD AND APPARATUS FOR OPERATING GASEOUS FUEL FIRED HEATER

BACKGROUND OF THE INVENTION

1. Field of the Invention

This invention relates to a method and apparatus for operating a heater, such as a gaseous fuel fired water heater. This invention also relates to a water heater having two or more burner assemblies and a mounting apparatus for releasably attaching each burner assembly to a bottom wall of a combustion chamber, such as a water heater combustion chamber.

2. Description of Related Art

Many conventional water heater combustion chambers intentionally operate with a combustion chamber that is substantially sealed, except for communication with the surrounding environment through a flue stack and an inlet opening for fuel and/or air. In some designs, the combustion air is introduced into the combustion chamber through a restricted opening, wherein a portion of the air is mixed with fuel in the burner nozzle and ignited in a primary combustion region and the remaining portion of the air is directed around the burner to complete combustion. The remainder of the combustion chamber is substantially sealed. U.S. Pat. No. 5,797,355 describes such a gas-fired heater. The purpose of the restricted air opening in the combustion chamber is to prevent a combustion flame from passing from the combustion chamber to the ambient surroundings.

Alternatively, the heater may be constructed with a substantially sealed combustion chamber in which all or substantially all of the combustion air and fuel are directed through an inlet nozzle to the burner, denoted as a fully premixed or simply premixed burner, with the intent of improving burner and overall system performance. For example, U.S. Pat. No. 5,355,841 describes a gas-fired heater with a premixed burner having a substantially sealed combustion chamber. It is apparent that many conventional designs having premixed burner systems try to achieve a gas tight seal between the combustion chamber and a tank wall in order to limit the entry of secondary combustion air.

A common phenomenon associated with water heater designs employing premixed burners is an undesirable noise, upon ignition and during steady state operation of the combustion chamber. The noise is initiated by the transient pressure rise associated with burner ignition, and may persist during steady state operation if one or more frequencies generated by flame instabilities or other periodic energy input from the burners corresponds with one or more structural or fluidic natural frequencies of the water heater and if there is insufficient system damping to mitigate the acoustic response. Various approaches have been taken to provide noise reduction and/or pressure relief in the substantially sealed combustion chamber, as taught in U.S. Pat. Nos. 5,317,992, 5,435,716 and 5,791,298, including insulation provided on the interior of the combustion chamber, a diaphragm on the bottom of the combustion chamber, and openings in the combustion chamber covered by porous material or flaps. These approaches add to system cost and manufacturing complexity, and introduce additional components that can negatively impact reliability.

SUMMARY OF THE INVENTION

It is one object of this invention to provide a method and apparatus for operating a water heater wherein a pressure relief void is in communication with the combustion chamber, to relieve chamber pressure during ignition and also to prevent a combustion flame from passing through the pressure relief void during operational combustion.

It is another object of this invention to provide a gaseous fuel fired water heater that has two burner assemblies mounted within or exposed to a combustion chamber.

It is yet another object of this invention to provide a mounting apparatus for releasably attaching a burner assembly to a bottom wall or a base plate of a water heater combustion chamber.

The method and apparatus of this invention reduce undesirable noise associated with ignition and with steady state or operational combustion. The method and apparatus of this invention enhance design flexibility by providing a relatively broad range of port loading, the firing rate per square inch of burner material. The method and apparatus of this invention also enhance scale-up capabilities which allows one particular burner assembly design to be used in different operations with various load settings.

The above and other objects of this invention are accomplished with a method wherein a fuel and air mixture, preferably but not necessarily pre-mixed and containing sufficient air to completely combust the quantity of fuel, is introduced into a burner and burned or combusted within a combustion chamber. The fuel and air mixture is ignited within the combustion chamber. An exhaust flue forms communication between the combustion chamber and an ambient environment which surrounds the combustion apparatus. Combustion products discharge through the exhaust flue.

In a pre-combustion condition, the combustion chamber is filled with or houses a fluid, mostly air or another suitable oxidant. Upon initial ignition of the fuel and air mixture, a first portion of the pre-combustion fluid passes through a pressure relief void and a second portion of the pre-combustion fluid passes through the exhaust flue. Conventional water heater apparatuses having premixed burner systems try to seal the combustion chamber, except for communication with an air supply and the exhaust flue, which the prior art refers to as a substantially sealed chamber. According to this invention, the pressure relief void is intended to form a combustion chamber which is not substantially sealed.

In one embodiment of this invention, the pressure relief void is sized large enough to relieve an ignition pressure from the combustion chamber when the fuel and air mixture is initially ignited yet is sized small enough to prevent a combustion flame from passing through the pressure relief void during ignition and/or operational combustion of the continuously supplied fuel and air mixture.

The pressure relief void can have many different sizes, shapes, forms, and locations with the combustion chamber, as long as an effective area of the pressure relief void adequately relieves the ignition pressure and prevents the combustion flame from passing through the pressure relief void during ignition and/or operational combustion. For example, the pressure relief void can be formed by a peripheral gap between the combustion chamber wall and a vessel wall, such as of a water tank of the water heater. In other embodiments, the pressure relief void can be incorporated in the mounting structure for the pilot assembly or the bottom wall or side wall of the combustion chamber. Many different structural elements and configurations can be used to maintain or form the pressure relief void.

In one embodiment of this invention, the water heater apparatus has two or more burner assemblies mounted to a bottom wall of the combustion chamber. In one embodiment, two burner assemblies are positioned a distance apart from each other and form a catch area between the burner assemblies. The catch area is preferably but not necessarily located on the bottom wall, for catching debris fallout and/or condensation which may occur during combustion.

In another embodiment of this invention, each burner assembly preferably has a mounting apparatus for releasably attaching the burner assembly with respect to a bottom wall that at least partially defines the combustion chamber. The mounting apparatus includes a retainer which is secured, either fixedly or releasably, to the burner assembly. A clip is attached to the bottom wall. The clip has an end portion spaced from the bottom wall and thus forms a receiver. A portion of the retainer can be engaged within the receiver. Once engaged, a removable fastener can be used to fasten another end of the retainer against the bottom wall.

In one embodiment, the fastener is a screw. In another embodiment the fastener includes a catch or latch which can be removably engaged within a shoulder of the bottom wall. Any other suitable connecting device can be used to quickly attach and detach the burner assembly with respect to the bottom wall. The mounting apparatus of this invention simplifies field installation and/or maintenance of burner assemblies mounted within water heaters.

BRIEF DESCRIPTION OF THE DRAWINGS

The technical features of this invention are described in the specification and the claims, and are better understood in view of the drawings, wherein:

DETAILED DESCRIPTION OF PREFERRED EMBODIMENTS

The method and apparatus of this invention, including individual or combined steps and/or elements, can be used to construct new water heaters or can be used to retrofit existing water heaters, including their designs, operating methods, apparatuses and/or manufacturing methods. One operting method according to this invention is described in view of FIGS. 1–4.

The method and apparatus of this invention are particularly suitable for gaseous fuel fired water heaters, such as those having a natural draft and/or non-condensing operation. For example, the method and apparatus of this invention can be used with Volume I Storage Type Gas Fired Water Heaters, according to United States standards such ANSI Z21.10.

Figure 1:
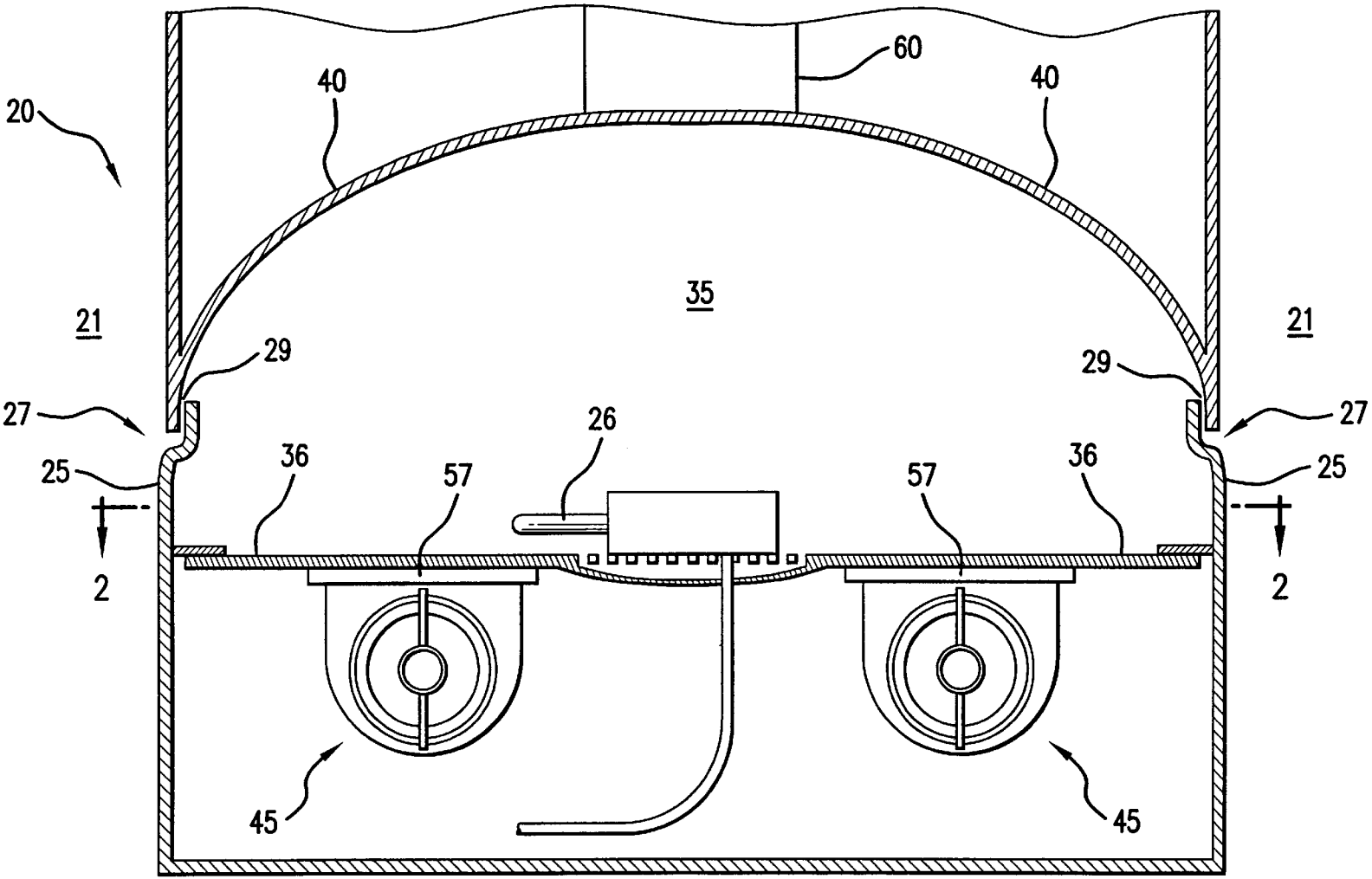
FIG. 1 is a schematic sectional view of a lower portion of a water heater, according to one embodiment of this invention.

The method of this invention is used to combust a fuel and air mixture within a combustion chamber, such as of a gaseous fuel fired water heater. As shown in FIG. 1, in a conventional manner, water heater 20 comprises combustion chamber 35 which is in communication with exhaust flue 60. Also in a conventional manner, exhaust flue 60 is in communication with ambient environment 21 surrounding water heater 20.

Figure 4:
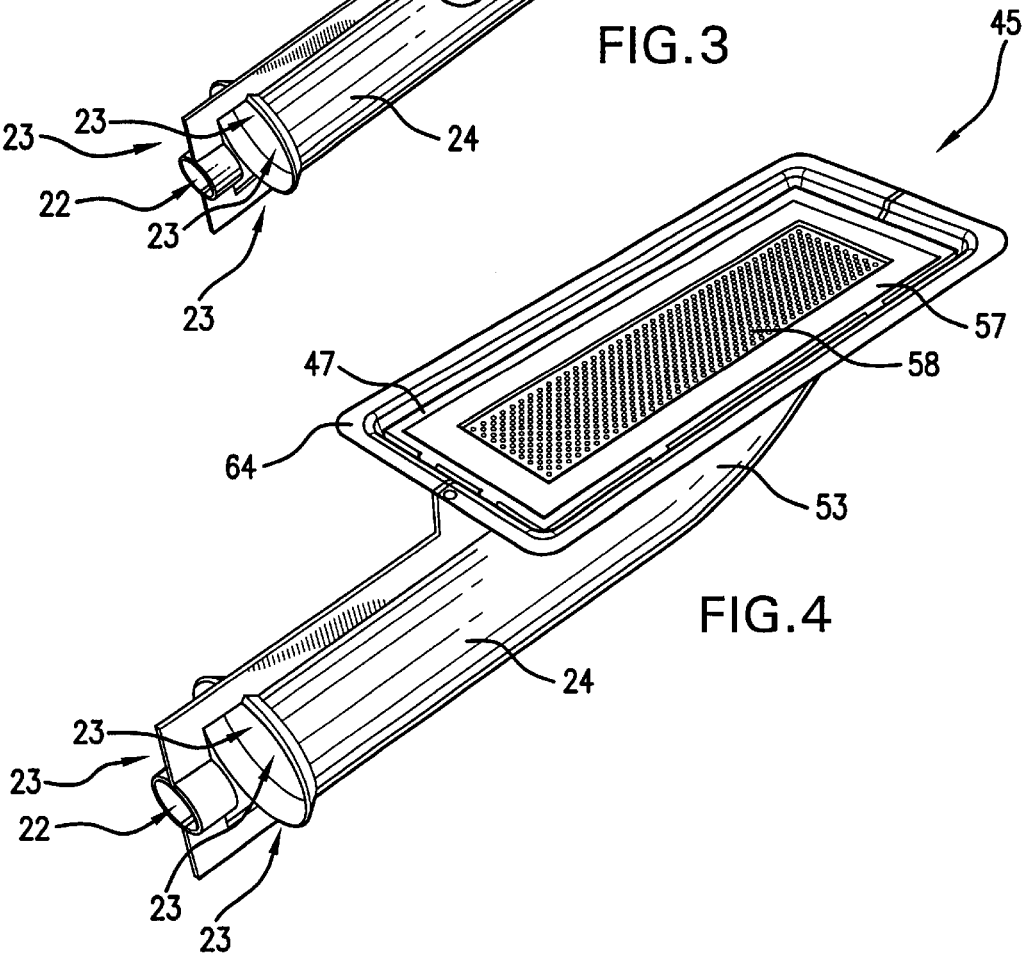
FIG. 4 is a schematic view of the burner assembly shown in FIG. 3, but in an assembled condition.

As shown in FIG. 4, fuel supply 22 and air supply 23 are introduced into venturi 24. In one embodiment of this invention, the fuel and the air are mixed within venturi 24 so that a pre-mixed fuel and air mixture is supplied to burner material 57 of burner assembly 45. It is apparent that the fuel and the air can be pre-mixed and/or can be supplied to burner material 57 through any other nozzle or inlet or in any other suitable manner known to those skilled in the art of combustion.

As used throughout this specification and in the claims, the term fuel is intended to relate to any gaseous fuel used in combustion, such as natural gas, propane, and other suitable combustible gases, or any suitable vaporized fuel. Also as used throughout this specification and in the claims, the term air is intended to relate to atmospheric air or any other suitable oxidant used to combust fuel.

The fuel and air mixture passes through venturi 24 or any other suitable inlet nozzle and is discharged from a flame holding device, such as burner material 57. A combustion flame is preferably established on the surface of burner material 57.

Figure 2:
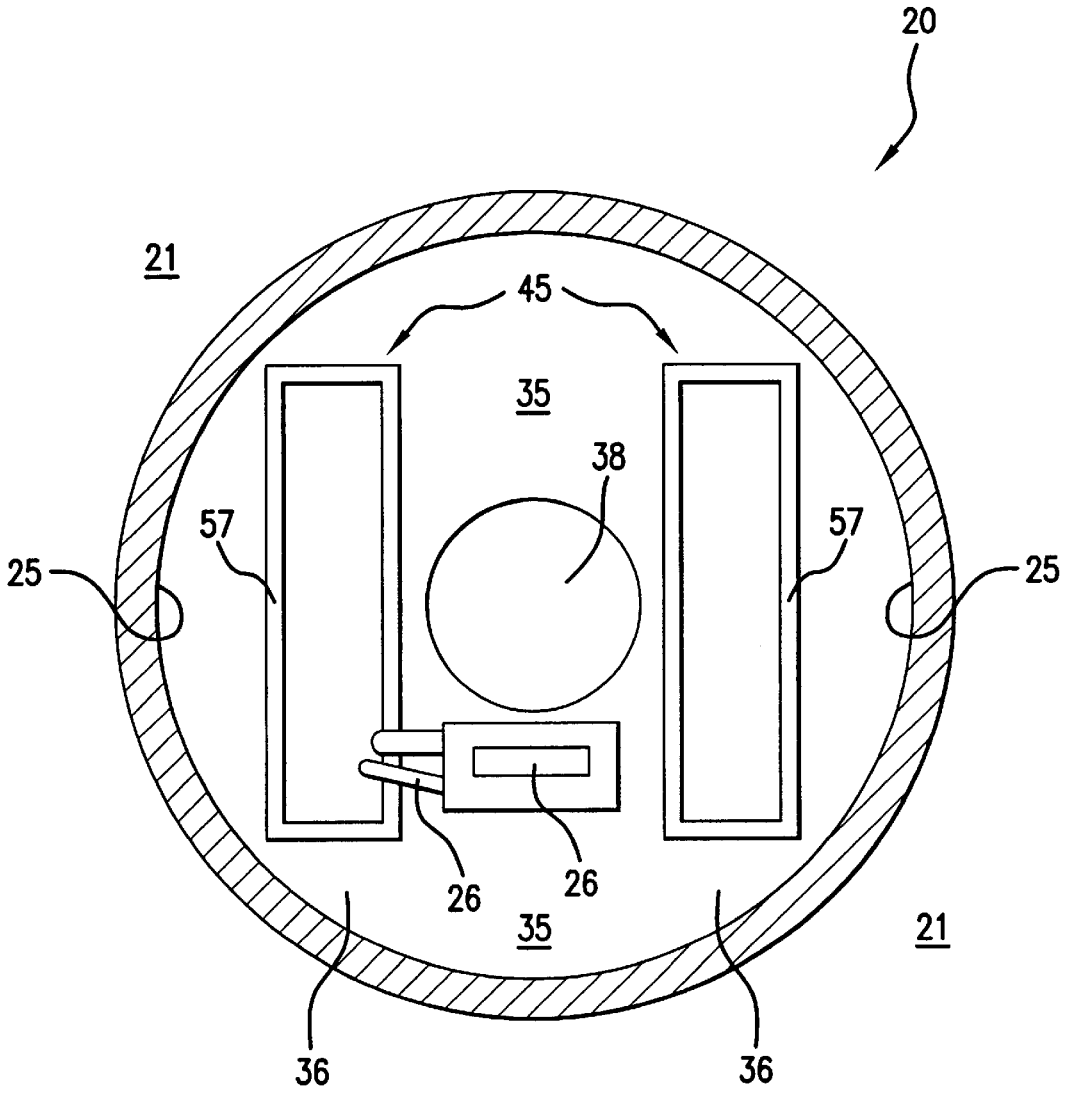
FIG. 2 is a schematic sectional view, taken along line 2—2 as shown in FIG. 1, of the bottom wall having two mounted burner assemblies.
Figure 3:
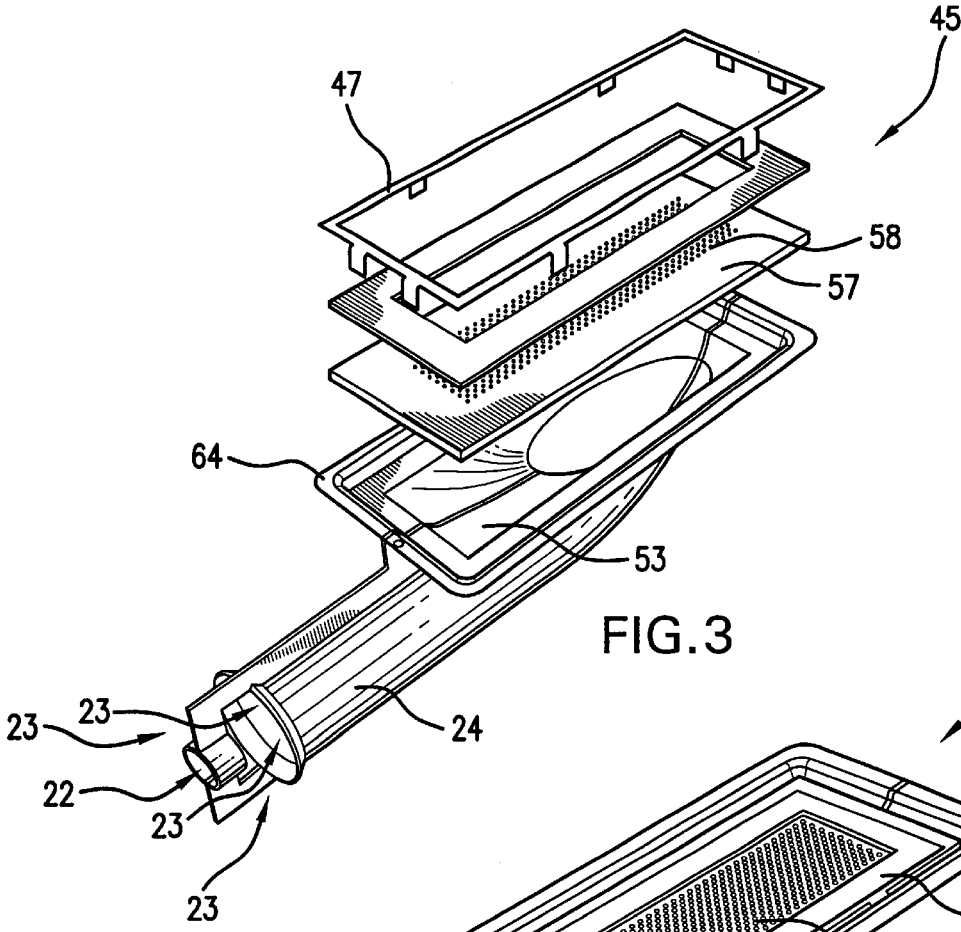
FIG. 3 is an exploded perspective view of a burner assembly, according to one embodiment of this invention.

As shown in FIGS. 1 and 2, pilot 26 is used to ignite the fuel and air mixture. In one embodiment, pilot 26 is used only upon initial ignition of the fuel and air mixture. In a combustion system having two burner assemblies 45, pilot 26 or another suitable ignitor can be strategically positioned to ignite the fuel and air mixture at the surface of one burner material 57, which can then be used to light the fuel and air mixture at the surface of another burner material 57. Once a combustion flame is established or sustained, it is possible to extinguish pilot 26 if the combustion flame then ignites the continuously flowing fuel and air mixture.

In a pre-combustion state, for example before ignition, combustion chamber 35 is filled with a fluid. Depending upon conditions, the fluid may include air and/or combustion products which remain within combustion chamber 35, such as shortly after shut down of water heater 20. Many conventional water heaters with premixed burner systems which operate with a combustion chamber that is substantially sealed produce an undesirable noise upon ignition due to the transient pressure pulse in the combustion chamber. Except for the communication with the flue stack and the inlet nozzle, these conventional water heaters are intentionally designed to achieve an otherwise completely sealed combustion chamber, for example to prevent additional combustion air from entering the combustion chamber.

Figure 11:
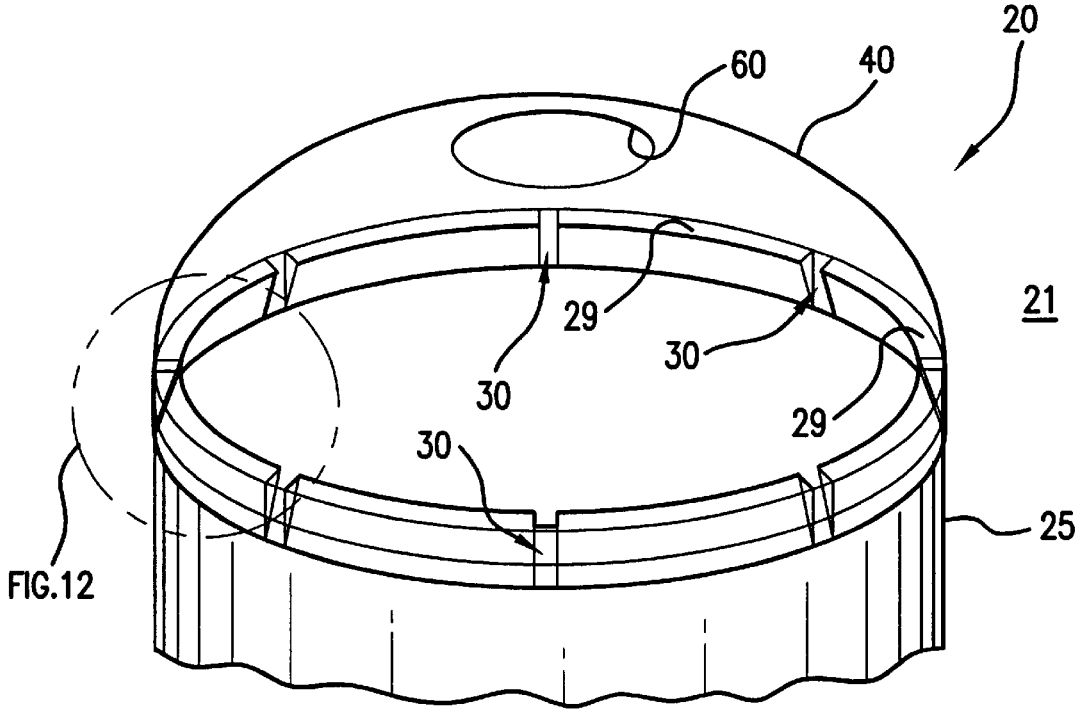
FIG. 11 is a perspective top view of a lower portion of a water tank attached with respect to an upper portion of a combustion chamber wall, to form a peripheral gap, according to one embodiment of this invention.
Figure 12:
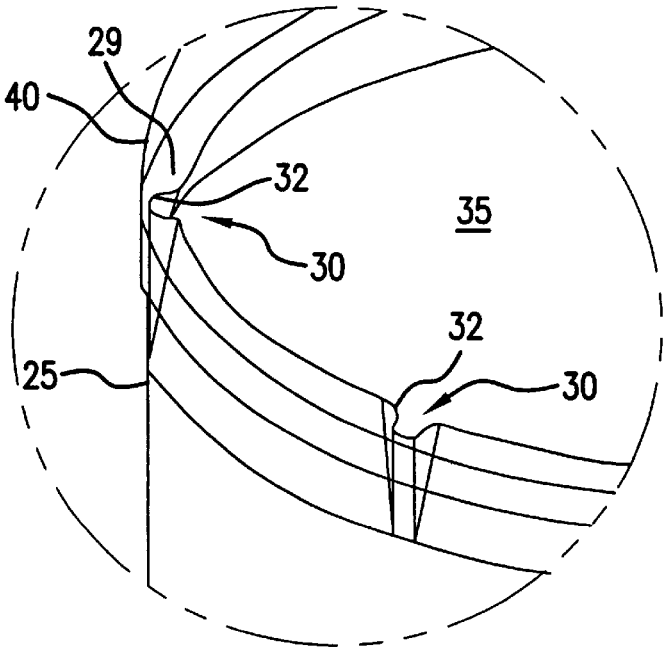
FIG. 12 is an enlarged perspective top view of a ledge area showing a peripheral gap, according to the embodiment as shown in FIG. 11.

Directly contrary to conventional water heater sealed combustion chambers, the method and apparatus of this invention, in addition to forming communication with exhaust flue 60 and venturi 24 or another suitable inlet nozzle, intentionally forms communication between combustion chamber 35 and ambient environment 21. In one embodiment of this invention, pressure relief void 27 forms the intentional communication between combustion chamber 35 and ambient environment 21, such as shown in FIGS. 1 and 11, through peripheral gap 29.

In one embodiment of this invention, upon ignition of the fuel and air mixture within combustion chamber 35, a first portion of the pre-combustion fluid is discharged through pressure relief void 27 and a second portion of the pre-combustion fluid is discharged through exhaust flue 60. Pressure relief void 27 is preferably sized large enough to relieve an ignition pressure from combustion chamber 35 upon ignition of the fuel and air mixture and yet is sized small enough to prevent a combustion flame from passing through pressure relief void 27 during operational combustion of the continuously flowing fuel and air mixture.

An effective area of pressure relief void 27 can be sized and/or shaped relative to an effective area of exhaust flue 60, so that a first pressure drop or flow rate across pressure relief void 27 is less than or significantly less than a second pressure drop or flow rate across exhaust flue 60. With such design, the ignition pressure is adequately relieved through pressure relief void 27. The pressure relief upon ignition significantly reduces undesirable noise associated with other conventional water heater sealed combustion chamber designs.

In one embodiment according to this invention, the effective area of pressure relief void 27 can be sized as a ratio of the effective area of exhaust flue 60. The areas can be changed, particularly relative to each other, to achieve different ratios that vary depending upon geometric and operational parameters of water heater 20. As an example, water heater 20 may have pressure relief void 27 formed by a 0.060 inch gap about a 16 inches diameter combustion chamber 35, which operates in communication with a 4 inches diameter exhaust flue 60. In this particular example, the dimensions result in a ratio of about 0.24 of the area of pressure relief void 27 over the area of exhaust flue 60. However, it is apparent that other suitable area ratios can vary significantly, depending upon the operating conditions and the geometry of water heater 20.

During operational combustion, such as the condition where the fuel and air mixture continuously flows through burner assembly 45 and a combustion flame is established on the surface of burner material 57, relatively little or no combustion products flow out of the combustion chamber through pressure relief void 27, and relatively little or no air flows into the combustion chamber through pressure relief void 27. If desired, it is possible to control a leakage rate of combustion products and/or air passing through pressure relief void 27 during operational combustion, such as by selecting a different effective area for pressure relief void 27.

As shown in FIG. 1, peripheral gap 29 forms pressure relief void 27. Peripheral gap 29 is preferably but not necessarily in a range from about 0.055 inch to about 0.065 inch, preferably about 0.060 inch.

Figure 13:
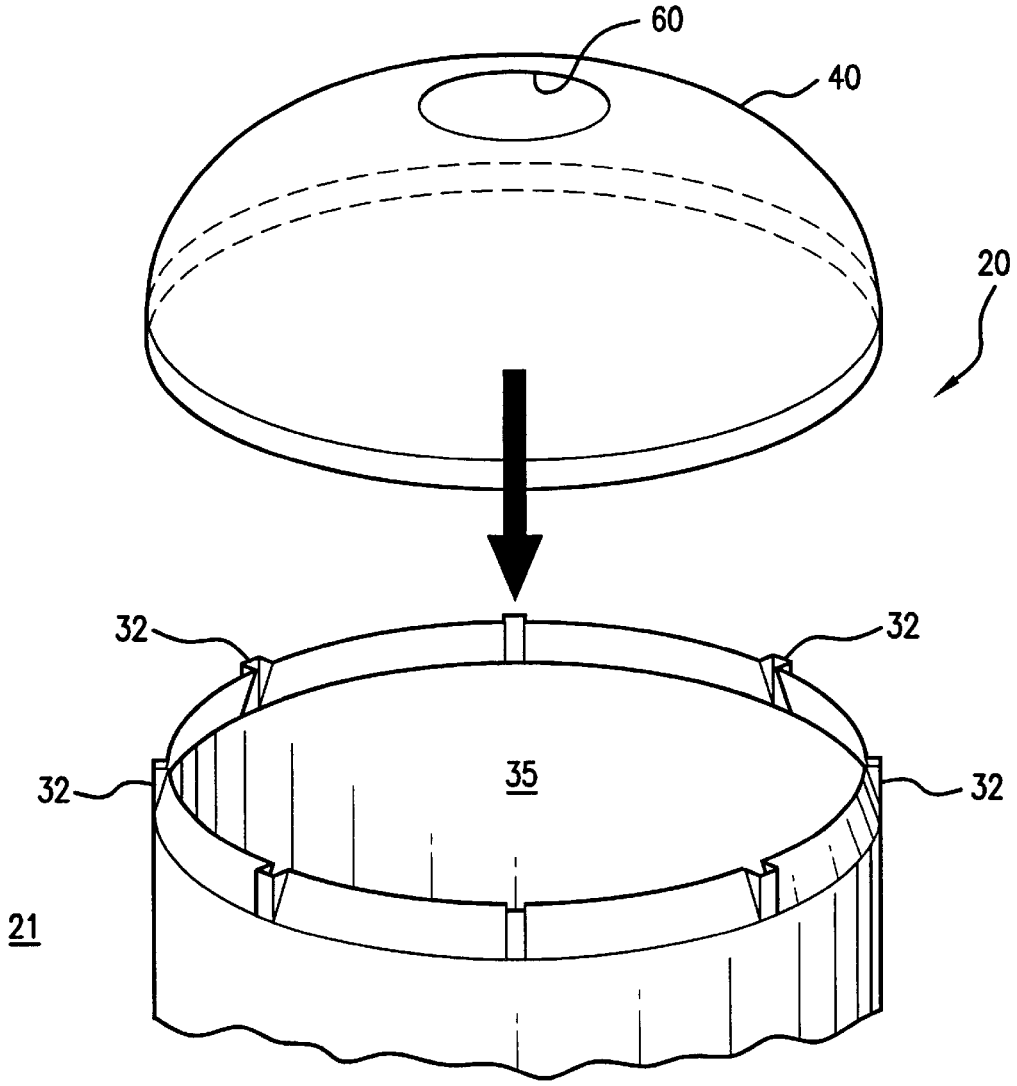
FIG. 13 is an exploded perspective top view of a lower portion of a water tank above an upper portion of a combustion chamber wall, with an arrow showing a direction of attachment to form a peripheral gap, according to one embodiment of this invention.

Spacer element 30 can be used to maintain peripheral gap 29, as shown in FIG. 1 between chamber wall 25 and vessel wall 40. FIG. 11 shows another embodiment of this invention where protuberance 32 extends from chamber wall 25 that partially defines combustion chamber 35, but protuberance 32 can also extend from the inner surface of the lower edge of vessel wall 40. Protuberance 32 or another suitable spacer element 30 can be positioned at selected circumferential intervals about the periphery of combustion chamber 35. For example, as shown in FIG. 13, protuberances 32 can be positioned at eight locations, each about 45 degrees apart, about the periphery of combustion chamber 35. It is apparent that any other suitable mechanical spacer element 30 can be used to fix a size and/or shape of pressure relief void 27.

Figure 14:
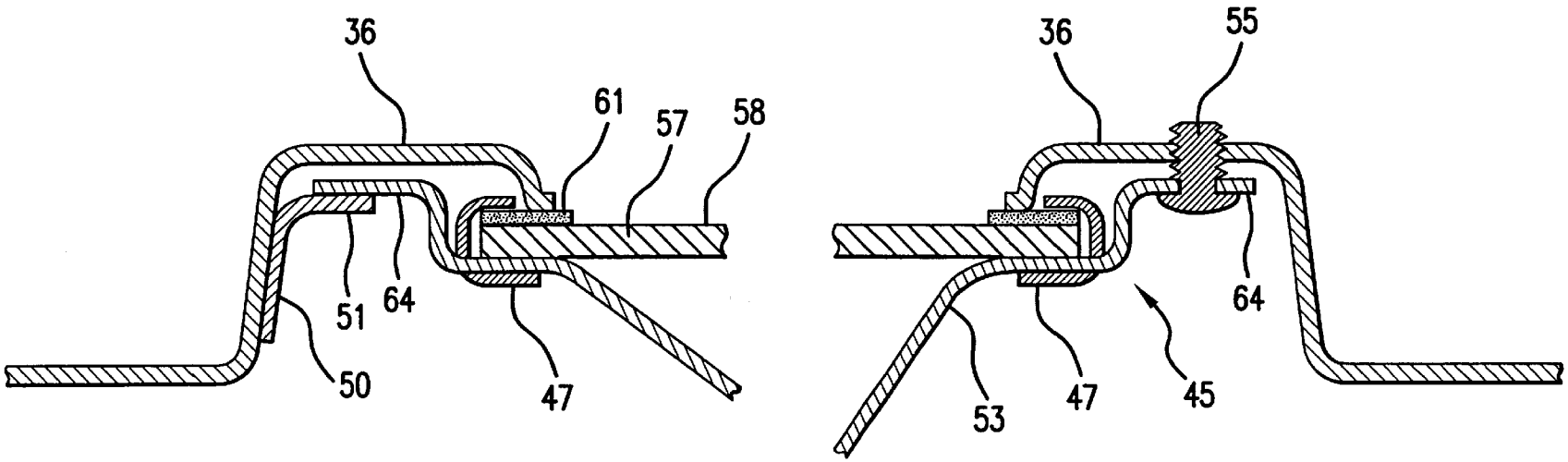
FIG. 14 is a partial cross-sectional view of a burner assembly mounted with respect to a bottom wall defining a combustion chamber, according to one embodiment of this invention.
Figure 15:
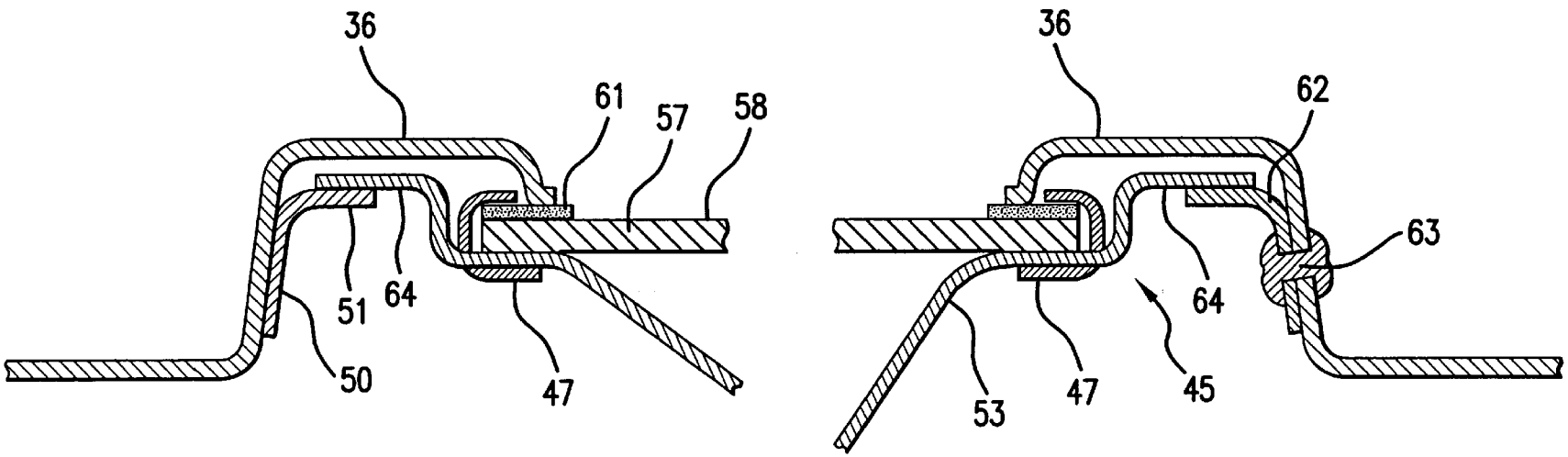
FIG. 15 is a partial cross-sectional view of a burner assembly mounted with respect to a bottom wall which defines a combustion chamber, according to another embodiment of this invention.

In one embodiment according to this invention, burner material 57 is a self-supporting mat structure. The self-supporting mat structure may comprise a plurality of ceramic fibers coated with a silicone carbide material or another suitable material. The ceramic fibers can be solidly welded together or otherwise fused into a rigid, porous matrix. The self-supporting mat structure can be processed, for example as sheets having a thickness of approximately 0.10–0.15 inch. The porosity of the bulk material may allow a quantity of the fuel-air mixture to flow through the entire surface area. Perforations throughout the bulk material can be formed in a regular pattern to increase or obtain the suitable port loading, as defined by firing rate per square inch of burner surface. A suitable burner mat is offered by Schott Gas Systems, and is marketed as a Ceramat® burner mat, which has relatively low thermal conductivity, a rigid self-supporting structure, and low thermal expansion, all of which provide a burner with stable combustion, low emissions, even radiation, fast reaction and a wide modulation range. A self-supporting mat structure or another suitable burner material 57 can be mounted with respect to bottom wall 36, such as shown in FIGS. 14 and 15.

Figure 7:
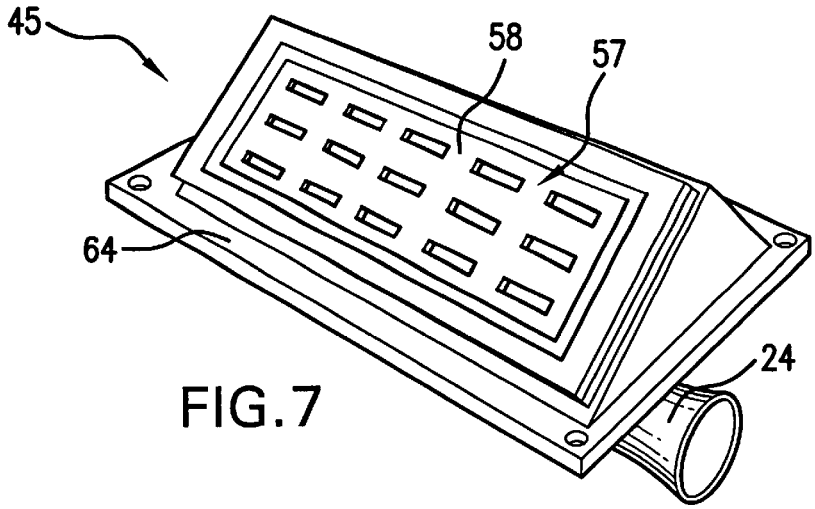
FIG. 7 is a perspective view of a burner assembly mounted at an angle with respect to a bottom wall, according to one embodiment of this invention.
Figure 8:
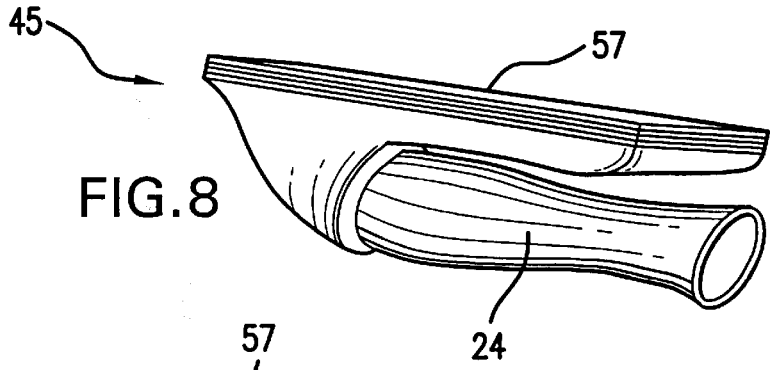
FIG. 8 is a perspective view of a burner assembly, according to another embodiment of this invention.
Figure 9:
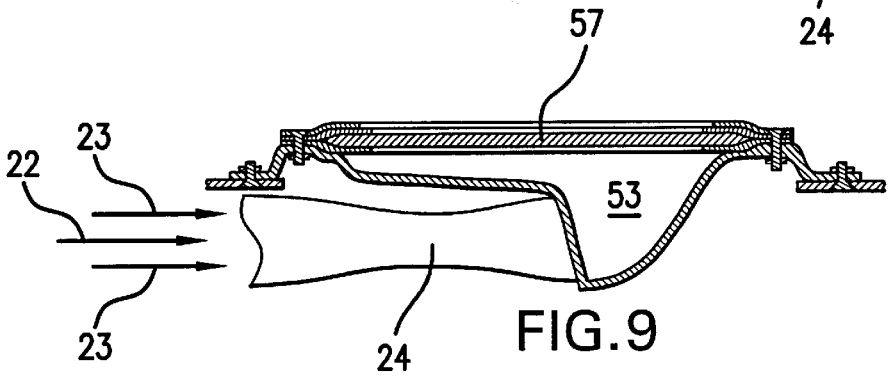
FIG. 9 is a sectional view taken along a longitudinal axis of the burner assembly as shown in FIG. 8.
Figure 10:
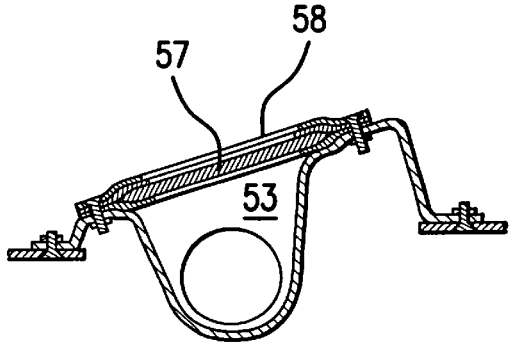
FIG. 10 is a sectional view taken in a direction transverse to the longitudinal axis of the burner assembly as shown in FIG. 7.

FIGS. 7 and 8 show different embodiments for mounting burner material 57 in burner assembly 45. FIGS. 9 and 10 show plenum 53. In one embodiment, the fuel and air mixture are discharged from venturi 24 or another suitable inlet nozzle, into plenum 53. The fuel and air mixture is then discharged from plenum 53 through burner material 57.

Burner material 57 may be mounted to plenum 53 in burner assembly 45 using retainer 47. Insulator 61 can be positioned between bottom wall 36 and burner material 57, for example to reduce heat transfer between burner material 57 and both bottom wall 36 and retainer 47, and to prevent combustion flames from burner material 57 from quenching or attaching to edges of bottom wall 36.

Figure 5:
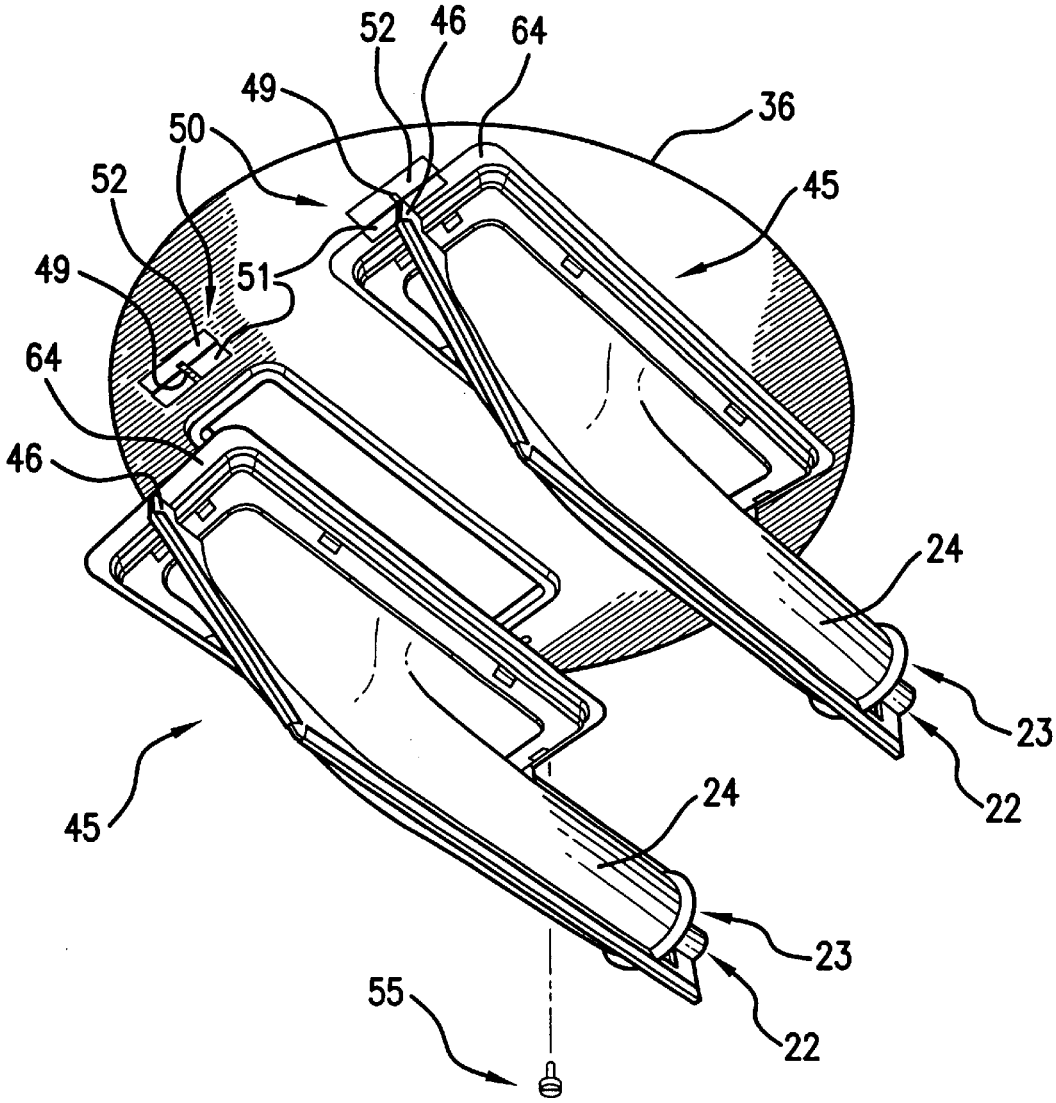
FIG. 5 is a perspective bottom view of a bottom wall having two burner assemblies, one attached to the bottom wall and another detached from the bottom wall, according to one embodiment of this invention.
Figure 6:
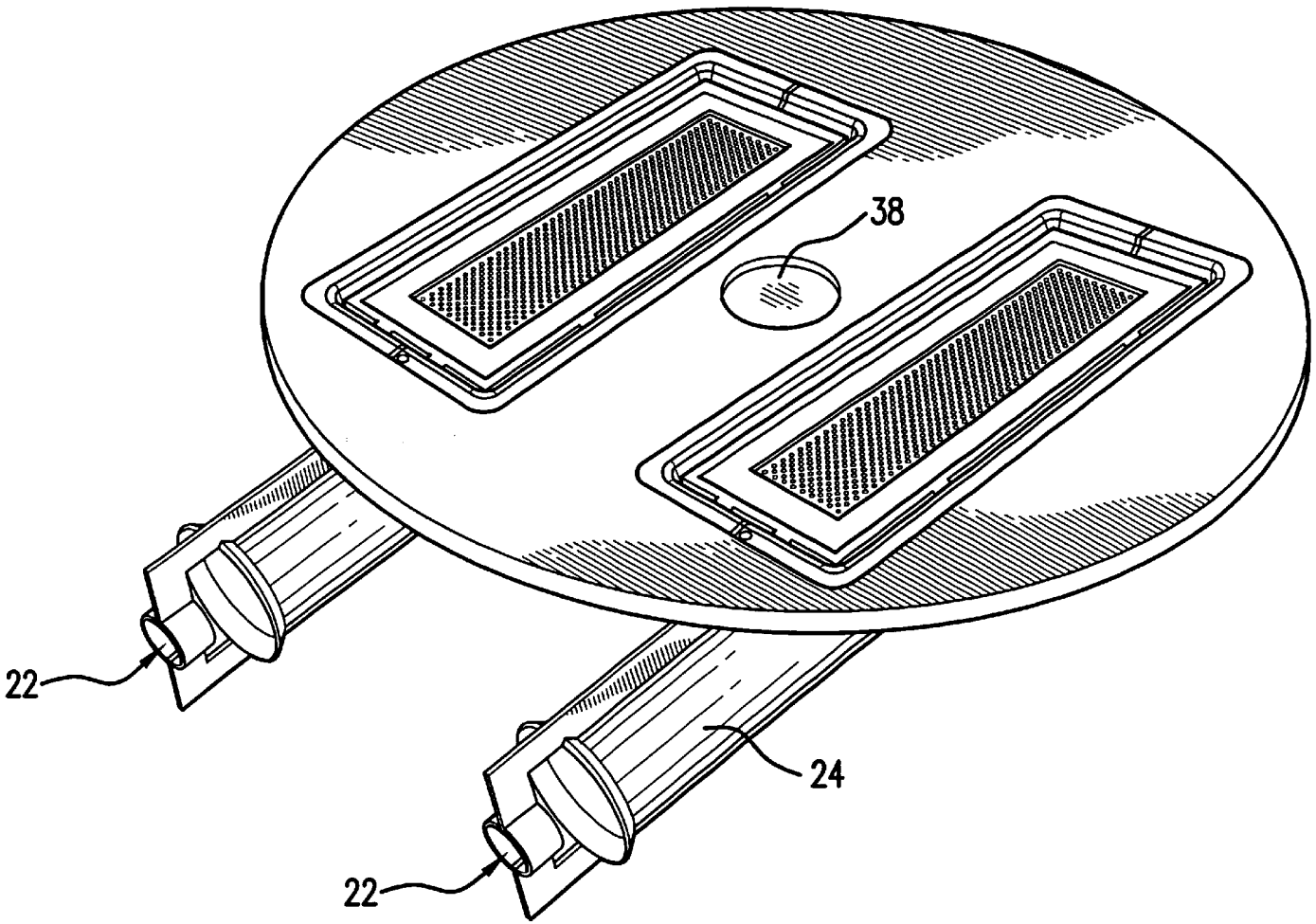
FIG. 6 is a perspective top view of the bottom wall with the two burner assemblies, according to the embodiment shown in FIG. 5.

FIGS. 5 and 6 show one embodiment of water heater 20 having two burner assemblies 45 mounted to bottom wall 36. FIG. 5 shows one burner assembly 45 attached to bottom wall 36 and another burner assembly 45 detached from bottom wall 36.

In one embodiment of this invention, a mounting apparatus can be used to releasably attach burner assembly 45 with respect to bottom wall 36. The mounting apparatus comprises flange 64, also shown in FIGS. 3, 5, 14 and 15 formed along the edge of plenum 53 in burner assembly 45, such as shown in FIG. 4. Clip 50 is attached to bottom wall 36. It is apparent that clip 50 can be welded, adhered, secured or otherwise mechanically connected to or with respect to bottom wall 36. In one embodiment, as shown in FIG. 5, clip 50 comprises base portion 52 and end portion 51 which is offset from or with respect to base portion 52. A transition between base portion 52 and end portion 51 forms a shoulder. FIGS. 14 and 15 show another embodiment of clip 50 attached with respect to bottom wall 36. In a mounted position of burner assembly 45 with respect to bottom wall 36, flange 64 limits movement of burner assembly 45 with respect to bottom wall 36, such as in a direction generally parallel to a longitudinal axis of burner assembly 45.

In one embodiment, clip 50 comprises slot 49, as shown in FIG. 5. In a mounted position of burner assembly 45 with respect to bottom wall 36, seam 46 or another suitable structure of burner assembly 45 is engaged within slot 49, for example to limit movement of burner assembly 45 in at least one direction with respect to bottom wall 36, such as in a direction which is generally transverse to the longitudinal axis of burner assembly 45.

A removable fastener is used to secure, attach or otherwise fasten an opposite end of flange 64 to or with respect to bottom wall 36. Fastener 55 may be a screw, as shown in FIGS. 5 and 14, or a catch or latch 62 as shown in FIG. 15. The catch or latch 62 may attach within a shoulder area of bottom wall 36. As shown in FIG. 15, latch 62 can pivot with respect to bottom wall 36 about pivot 63, which can be a pin, a rod or any other suitable mechanical pivot device. The shoulder area can be formed by a void within bottom wall 36, a shoulder formed as an integral part of bottom wall 36 or a shoulder structure attached to bottom wall 36. It is apparent that any other suitable removable fastener can be used in lieu of either the screw or the catch or latch 62.

Flange 64, clip 50 and fastener 55 and/or latch 62 can be used to quickly attach or detach burner assembly 45 with respect to bottom wall 36. This is particularly important when servicing a water heater. The design of this invention provides easy access for field installation and/or maintenance.

In an embodiment where two or more burner assemblies 45 are mounted within combustion chamber 35, each burner assembly 45 is preferably positioned at a distance apart from each other to form catch area 38, such as shown in FIGS. 2, 6, 16 and 17. In another embodiment where only one burner assembly 45 is mounted within combustion chamber 35, burner assembly 45 forms an annular shaped burner that also forms catch area 38, such as shown in FIG. 18. According to such embodiment, the annular shape can be replaced with a simple arcuate shape which does not necessarily form a complete circle. In either embodiment, catch area 38 can be used to gather or collect debris fallout, condensation or any other combustion product resulting from operation of water heater 20. Catch area 38 is preferably centrally located on bottom wall 36 but may be located in any other suitable position, depending upon the overall design and structure of water heater 20.

Figure 16:
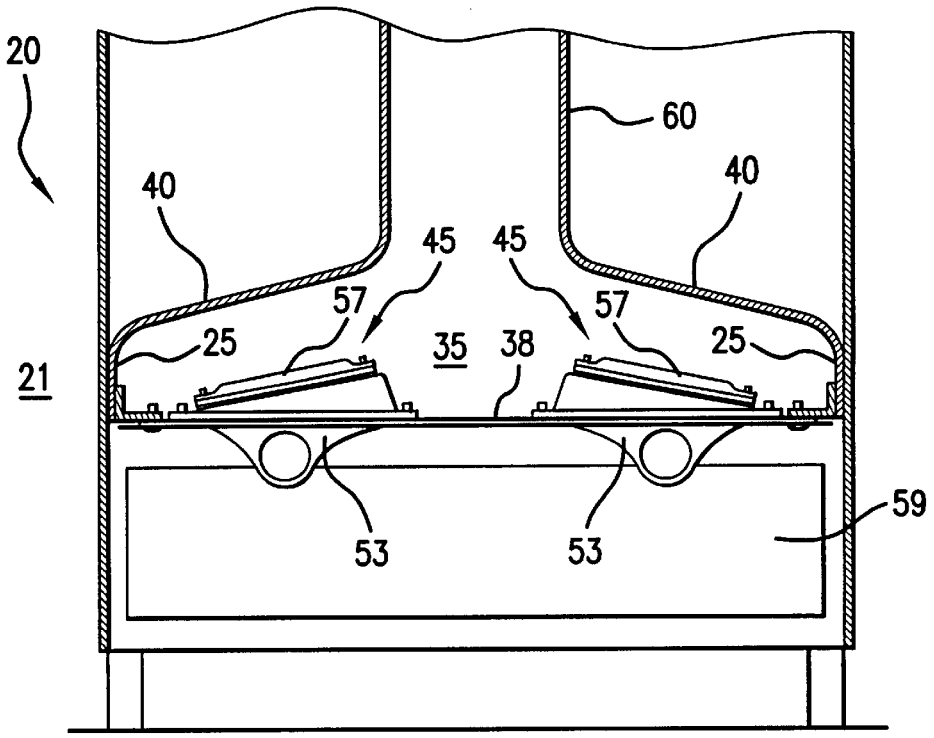
FIG. 16 is a schematic sectional view showing two burner assemblies mounted within a water heater, according to one embodiment of this invention.
Figure 17:
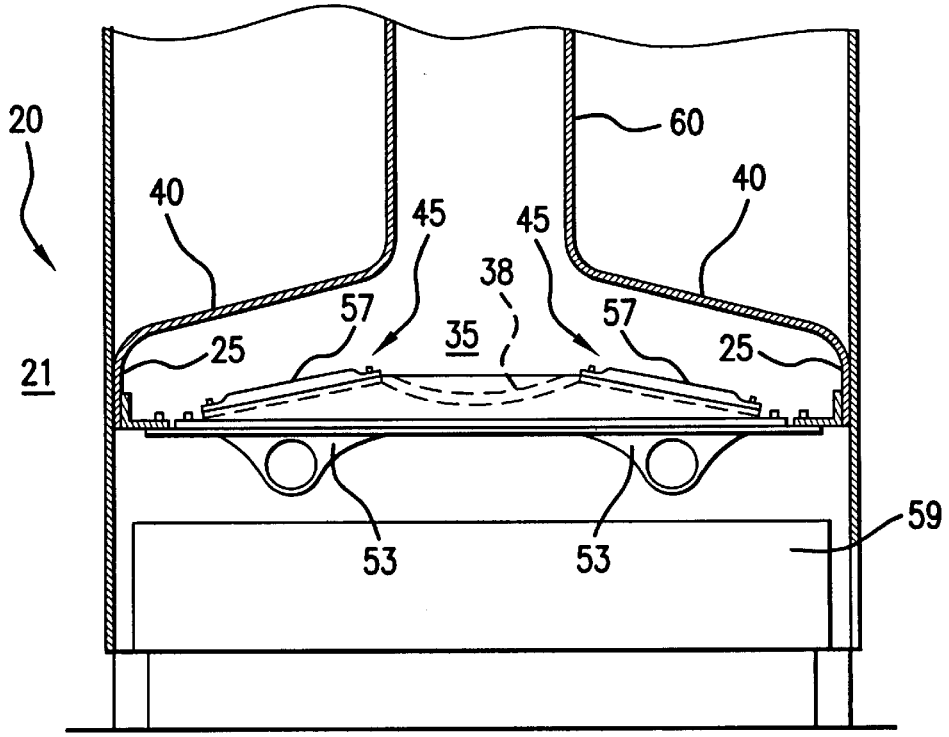
FIG. 17 is a schematic view showing two burner assemblies mounted within a water heater, according to another embodiment of this invention.
Figure 18:
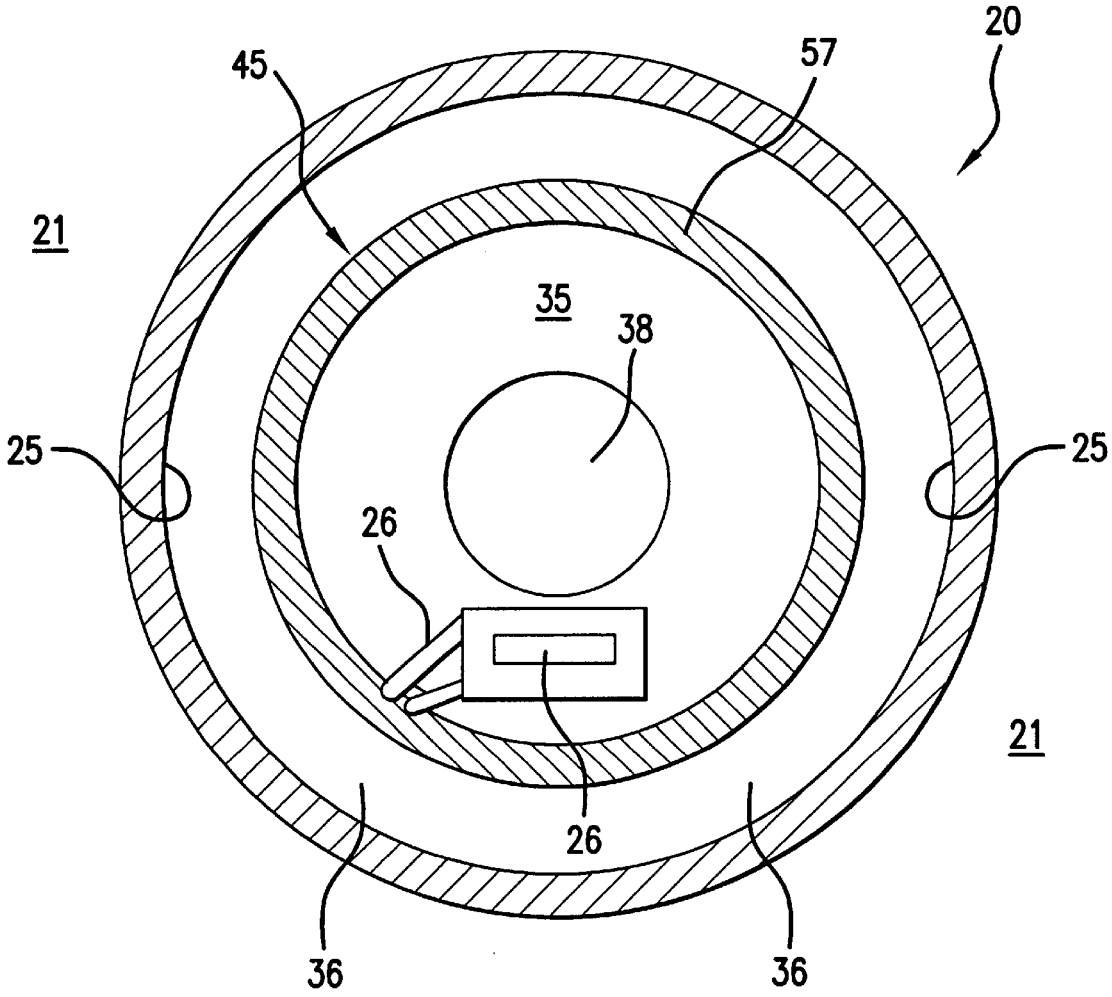
FIG. 18 is a schematic sectional view of a bottom wall having one arcuate or annular mounted burner assembly.

FIGS. 16 and 17 show general arrangements of water heater 20, with two burner assemblies 45 mounted at an angle with respect to bottom wall 36. Access area 59 within a side wall defining combustion chamber 35, may provide easy access to each burner assembly 45, for installation and/or maintenance purposes.

While in the foregoing specification this invention has been described in relation to certain preferred embodiments thereof, and many details have been set forth for purpose of illustration, it will be apparent to those skilled in the art that this invention is susceptible to additional embodiments and that certain of the details described can be varied considerably without departing from the basic principles of this invention.

What is claimed is:

1. In a method for combusting a fuel and air mixture within a combustion chamber which in a pre-combustion condition contains an amount of fluid, wherein an exhaust flue forms communication between the combustion chamber and an ambient environment, the improvement comprising:

discharging the fuel and air mixture from a flame holding device;

igniting the fuel and air mixture within the combustion chamber; and discharging a first portion of the amount of the fluid through a pressure relief void in communication with the ambient environment and discharging a second portion of the fluid through the exhaust flue, wherein the pressure relief void is formed as a peripheral gap between a combustion chamber wall that defines the combustion chamber and the exhaust flue.

2. In a method according to claim 1 wherein the first portion of the amount of fluid passes through the pressure relief void only upon ignition of the fuel and air mixture.

3. In a method according to claim 1 further comprising controlling a rate of the fluid passing through the pressure relief void.

4. In a method according to claim 1 wherein the rate is controlled by sizing the pressure relief void to allow the first portion of the amount of fluid to pass through the pressure relief void upon ignition and to prevent a combustion flame from passing through the pressure relief void during at least one of ignition and operational combustion.

5. In a method according to claim 1 wherein the peripheral gap is in a range from about 0.055 inch to about 0.065 inch.

6. In a method according to claim 1 wherein the fuel and air mixture is pre-mixed upstream of the flame holding device.

7. In a method according to claim 6 wherein the fuel and air mixture is pre-mixed within a venturi.

8. In a method according to claim 1 wherein a first flow rate through the pressure relief void is significantly less than a second flow rate through the exhaust flue.

9. In a method according to claim 1 wherein the combustion chamber is not substantially sealed.

* * * * *